US006139281A

United States Patent [19]

Schooler

[11] Patent Number: 6,139,281

[45] Date of Patent: Oct. 31, 2000

[54] SUMP PUMP ALARM SYSTEM UTILIZING A DOORBELL CHIME

[76] Inventor: Paul T. Schooler, 16285 Erin, Fraser, Mich. 48026

[21] Appl. No.: 09/047,003

[22] Filed: Mar. 24, 1998

[51] Int. Cl.[7] ..... F09B 49/04

[52] U.S. Cl. ..... 417/40; 417/63

[58] Field of Search ..... 417/63, 40; 340/539, 340/531, 623, 217, 628

[56] References Cited

U.S. PATENT DOCUMENTS

| | | | |
|---|---|---|---|
| 2,187,194 | 1/1940 | Chapman . | |
| 4,187,503 | 2/1980 | Walton | 340/624 |
| 4,189,720 | 2/1980 | Lott | 340/539 |
| 4,363,031 | 12/1982 | Reinowitz | 340/539 |
| 4,369,483 | 1/1983 | Wilhelmi | 340/623 |
| 4,444,545 | 4/1984 | Sanders et al. . | |
| 4,529,359 | 7/1985 | Sloan . | |
| 4,777,474 | 10/1988 | Clayton | 340/531 |
| 4,805,066 | 2/1989 | Mergenthaler . | |
| 4,812,820 | 3/1989 | Chatwin | 340/531 |
| 4,841,282 | 6/1989 | Reis | 340/628 |
| 5,015,152 | 5/1991 | Greene . | |
| 5,173,019 | 12/1992 | Sdana . | |
| 5,234,319 | 8/1993 | Wilder . | |
| 5,252,030 | 10/1993 | Chikada . | |
| 5,314,313 | 5/1994 | Janesky . | |
| 5,371,491 | 12/1994 | Wu . | |
| 5,587,697 | 12/1996 | Rent . | |
| 5,672,050 | 9/1997 | Webber et al. . | |
| 5,696,493 | 12/1997 | Einck . | |

*Primary Examiner*—Charles G. Freay
*Attorney, Agent, or Firm*—Carlson, Gaskey & Olds

[57] ABSTRACT

Sump pump alarms are disclosed wherein existing home alarms are utilized to provide the indication of the failure of the sump pump. In one application a RF transmitter sends a signal from the sump pump to the doorbell. In a second application the warning is sent to the smoke alarm of the residence.

5 Claims, 1 Drawing Sheet

SUMP PUMP ALARM SYSTEM UTILIZING A DOORBELL CHIME

BACKGROUND OF THE INVENTION

This application discloses and claims a sump pump alarm system which utilizes an existing home alarm for the sump pump alarm.

Sump pumps are utilized in many residences to prevent flooding of the basement. Typically, a sump pump has an on switch float actuated to start the pump when a particular water level is reached. The sump pump then drives the water outwardly to a drain, preventing flooding of the basement.

If the sump pump fails for some reason, then the basement may become flooded. Thus, a good deal of effort has been made to provide alarms. These alarms are typically situated near the sump pump, and may be hard wired audible or visual alarms.

Since the sump pump is typically in the basement, the alarms are thus remote from the occupants of the residence. Although remote alarms have been proposed, they have typically required a hard wire connection.

It is an object of this invention to provide an alarm which is remote from the sump pump, and which is much more economical than the proposed prior art systems.

SUMMARY OF THE INVENTION

In a disclosed embodiment of this invention, a sump pump alarm is combined into an existing home alarm. In this way, an extra alarm is not necessary. In a preferred embodiment of this invention, the alarm is incorporated as an add-on feature which can be easily attached to existing sump pumps.

In one disclosed embodiment, the add-on alarm bolts on to a portion of the sump pump and includes a float carrying a switch. Once the float raises to a predetermined level, a switch contacts mating contact structure on the bracket, and a circuit is complete. The level is selected to only be actuated if the motor or pump has likely failed. At that time an indication is sent that the alarm signal should be actuated.

In one embodiment, the alarm signal includes an RF transmitter which transmits a signal to the doorbell of the residence. The doorbell is then actuated continuously for a period of time. This provides a very easily heard warning signal to the occupants.

In another embodiment, the alarm may be hard wired, and connected to an existing alarm such as the smoke alarm. Again, the occupant is provided with a clear indication of the existence of a problem with the sump pump.

These and other features of the present invention can be best understood from the following specification and drawings, the following of which is a brief description.

DETAILED DESCRIPTION OF A PREFERRED EMBODIMENT

Figure 1:
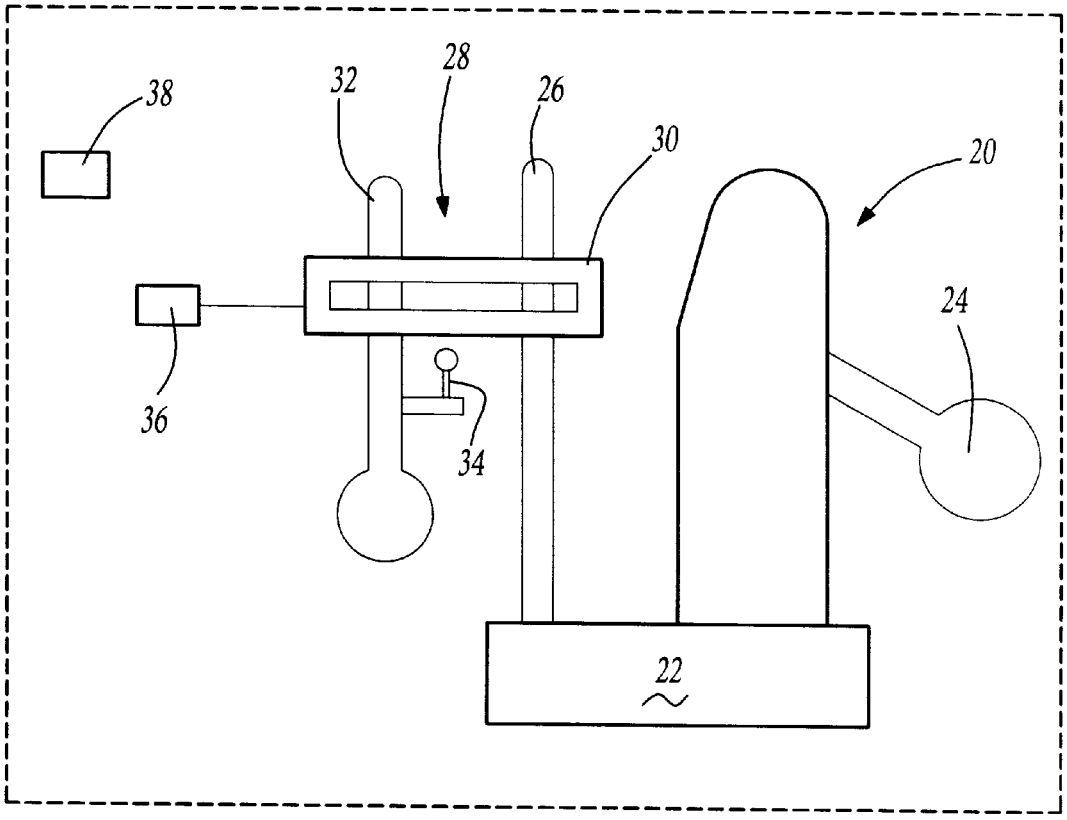
FIG. 1 shows an alarm system incorporating the present invention.

A sump pump 20 is illustrated in FIG. 1 incorporating a pump portion 22 and an on float switch 24. When the water level rises such that float switch 24 is moved, it actuates pump portion 22. Water is then driven through a outlet pipe 26 to a drain.

The present invention includes an easily added alarm unit 28. Bracket 30 may bolt onto outlet pipe 26 in any known fashion. A float portion 32 moves relative to bracket 30, and carries a switch contact 34. The details of the switch contact are well within the skill of a worker in this art. It is a provision of the switch contact and the add-on float switch which is inventive. The same is true with regard to the details of the bracket. Some way of bolting the structure onto the pipe is necessary, however, a worker of ordinary skill in the art would be able to design several distinct functioning structures.

When the float 32 has moved to the point that switch contact 34 contacts an electrical contact on the bracket 30, then the sump pump 20 must not be functioning. A signal is then sent to a control 36.

Control 36 is preferably an RF transmitter, of the type known to send signals without any necessary wires. A signal is sent by transmitter 36 to an existing home alarm, such as a doorbell 38. Doorbells are known and commercially available wherein the doorbell button actuates an RF transmitter to actuate the doorbell chimes 38. The present invention is preferably incorporated into such a system such that the control 36 would also send a signal to the chimes 38. In this way, the occupant would be given an indication of the existence of a problem with the sump pump through a system which is easily added onto the sump pump, and easily incorporated into the doorbell system. With the present invention, the actuation of the chimes 38 would be continuous, which is distinct from the normal actuation of the doorbell system by a visitor. Thus, the occupant would have a clear indication that the sump pump is failing.

Figure 2:
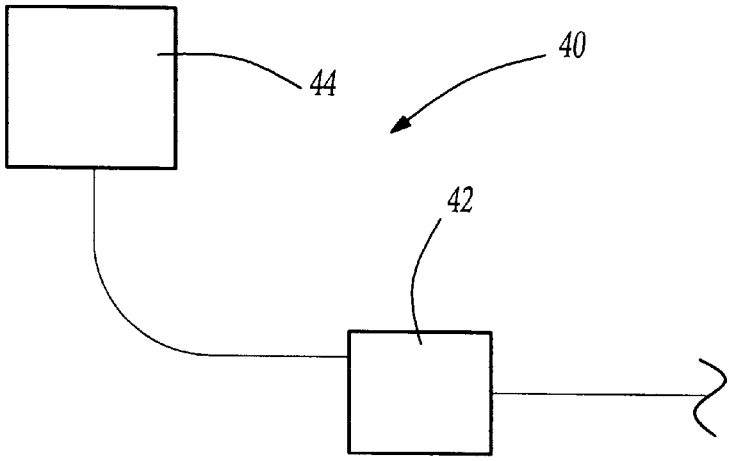
FIG. 2 shows a second embodiment alarm system.

FIG. 2 shows a second embodiment wherein the control 42 receives a signal from the switch 34 that there has been a problem with the sump pump system. A wire then provides a signal to an alarm 44 that the problem is occurring. The alarm 44 is preferably an existing home alarm, and may be a doorbell chime which does not receive RF signals or, alternatively, another alarm such as a smoke alarm.

Preferred embodiments of this invention have been disclosed, however, a worker of ordinary skill in the art would recognize that certain modifications come within the scope of this invention. For that reason, the following claims should be studied to determine the true scope and content of this invention.

What is claimed is:

1. A sump pump alarm comprising:

structure for being mounted adjacent a sump pump;

float structure including a switch for determining a failure of a sump pump, said float structure being operable to send a signal when the sump pump has failed; and a control to communicate said signal to an existing home alarm system, said existing home alarm system also provides a second alarm function, said existing home alarm system being a doorbell chime.

2. A system as set forth in claim 1, wherein said signal is sent from said control to said alarm by an RF transmitter.

3. A system as recited in claim 1, wherein there is a hard wire connection between said control and said alarm.

4. A system as recited in claim 1, wherein said structure for mounting said alarm to a sump pump includes a bracket which is mounted to an outlet pipe of a sump pump.

5. A system for a sump pump, and a sump pump comprising:

a sump pump, having a switch which is actuated when a water level reaches a predetermined level to actuate said sump pump;

an alarm system incorporating a second switch which is actuated at an after expected actuation of said first switch to send a signal that said sump pump is not properly functioning, said signal being sent from an RF transmitter, and said RF transmitter communicating with an existing home alarm system to provide a signal that said sump pump has failed, said existing home alarm system being a doorbell chime.

* * * * *